US012006673B2

(12) United States Patent
Carroll

(10) Patent No.: US 12,006,673 B2
(45) Date of Patent: Jun. 11, 2024

(54) INVERTED PLUNGER

(71) Applicant: Michael Carroll, Greenwood, IN (US)

(72) Inventor: Michael Carroll, Greenwood, IN (US)

( * ) Notice: Subject to any disclaimer, the term of this patent is extended or adjusted under 35 U.S.C. 154(b) by 32 days.

(21) Appl. No.: 17/836,729

(22) Filed: Jun. 9, 2022

(65) Prior Publication Data

US 2022/0396943 A1 Dec. 15, 2022

Related U.S. Application Data

(60) Provisional application No. 63/210,031, filed on Jun. 13, 2021.

(51) Int. Cl.
*E03C 1/30* (2006.01)

(52) U.S. Cl.
CPC ..... *E03C 1/30* (2013.01)

(58) Field of Classification Search
CPC ..... E03C 1/30; E03C 1/304
USPC ..... 4/255.01–255.12
See application file for complete search history.

(56) References Cited

U.S. PATENT DOCUMENTS 7,062,800 B1 * 6/2006 Alfred ..... E03D 9/00 4/255.11
7,299,519 B1 * 11/2007 Garry ..... E03C 1/308 4/255.01

FOREIGN PATENT DOCUMENTS

CN 105525661 A * 4/2016

* cited by examiner

*Primary Examiner* — Tuan N Nguyen
(74) *Attorney, Agent, or Firm* — Alexei P. Krasutsky

(57) ABSTRACT

An inverted plunger for unclogging pipes or toilets is described. The proposed inverted plunger does not have any openings filled with air, at the stretchable elastic bottom part, unlike all plungers described in the prior art. The proposed inverted plunger is equipped with the internal piston, that allows the pressure application to the narrower part of the stretchable bottom, leading to direct pressure from the stretched material to the liquid inside the pipe, avoiding the air-to-liquid pressure utilized in regular plungers. Using the electric motor in the proposed inverted plunger leads to the increased efficiency and to the easy use by the operator.

8 Claims, 6 Drawing Sheets

INVERTED PLUNGER

CROSS-REFERENCE TO RELATED APPLICATIONS

This application is based on and claims benefit to U.S. provisional application 63/210,031 filed on Jun. 13, 2021.

BACKGROUND OF THE INVENTION

The present invention relates to apparatus for removing clogs from pipes, more particularly obstructions from the bowl pipes, like toilet or sink drain pipes. The proposed apparatus allows for effortless and splash-free cleaning of obstructed bowl pipes.

DISCUSSION OF PRIOR ART

Toilet plunger was invented in 1874 by John Hawley (US158937A). In general, all plungers are made out of rubber or some other elastic material and are shaped like a cup or like a ball cut in half with a flared edge. The top portion of the cup, opposite to the flared edge, is usually attached to a handle to apply pressure, compressing the air inside the cup. The force created by the compression is transmitted to the water n the pipe. As water does not compress as much as the air, it serves as a piston that travels through the pipe, breaking down the obstruction.

The original plunger was improved by adding a flattened rim to create more pressure to the rubber cup (US186206). It was further improved by combining the plunger with either chemicals dispenser or the brush. All of the plungers that were invented to date are based on the idea of applying a force to the air-filled volume, usually by compression. The compressed air pressures the water in the toilet bowl or the pipe, moving the compressed water towards the clog or any obstruction. The compressed water affects the obstruction either by pushing it through or by breaking it in smaller pieces, releasing the clog, and allowing the water to travel through the pipe.

The previously described plungers always create some issues for the user. For instance, because of the half-cup-shaped opening, the pressure application through the handle leads to spills of the toilet bowl contents. Additionally, it is often difficult to align the plunger with the pipe's opening, which leads to the wasted effort, as the water pressure is being distributed in the undesired directions. Also, most of the currently used plungers require a sufficient use of the individual's muscle involvement, making it difficult for younger or older users to effectively clean the clogged toilets.

To improve the plunger's efficacy, the design with the narrower opening was presented. While the pressure direction might have been improved, the spills continue and the applied force decreases with the narrowing of the plunger's opening.

The plungers with the increased air pressure by mean of compressor were introduced to improve the efficacy of the plunger. While those could often improve the de-clogging, the spills get worse, and the possibility of the pipe bursting increases.

Thus, there is a clearly felt need for a new plunger that would decrease the spills, be gentler on the pipes, decrease the involvement of the muscle strength, while still effectively cleaning the clogged toilet bowls or clogged pipes.

The disclosed invention addresses these and some other issues.

SUMMARY OF THE INVENTION

Accordingly, the primary objective of the present invention is to provide a new and improved toilet bowl plunger.

Unlike all previously described, plungers, the present invention does not use the energy of the compressed air. Moreover, the presented inverted plunger does not involve any air as means of the force application and pressure transition. Instead of the half-cut cup shape, the present invention suggests the use of the inverted cup without any air opening.

The inverted cup is made from the elastic material and should be shaped to provide a watertight connection of the inverted cup's elastic body with the pipe or the toilet bowl opening. The narrowing protrusion at the tip of the elastic body of the inverted cup is aimed to be partially inserted in the pipe's opening, while the walls around the tip of the inverted cup create a watertight connection with the pipe's opening's walls.

The inside of the inverted cup is attached to a rod or a piston, allowing the elastic body of the inverted cup to be moved in and out of the pipe's opening by the application of force to the other end of the rod or a piston and due to the elasticity of the material of the inverted cup. Such application of force allows the elastic body of the inverted cup to penetrate the pipe inward upon the inner force application and remove the elastic body of the inverted cup outward upon the reversed force application. Such movements would create the direct impact of the elastic body of the inverted cup on the liquid inside the pipe. The repetitive movement of the elastic body of the inverted cup inside and out of the clogged pipe creates a vibration of liquid inside of the clogged pipe, leading to the destruction and removal of the debris.

The described mechanism allows for the direct force application to the liquid inside the pipe, utilizing the fact that liquid is less prone to compression than the air in the regularly used plungers. The repetitive and faster force application creates a higher vibration inside the clogged pipe, eventually breaking down the clog.

To avoid spills and contamination, the entire body of the inverted cup could be shaped in such a way that no water or air would be admissible to the rod or a piston, or any other moving parts. Additionally, to minimize the use of human force, the rod or a piston could be attached to an electric motor, allowing for a higher frequency vibration of the elastic body of the inverted cup with a simple flip of a button. To achieve the vertical vibration of the rod or a piston, the eccentric crank could be attached to a rotating axle of the electric motor. In mechanical engineering, an eccentric is a circular disk solidly fixed to a rotating axle with its center offset from that of the axle.

The described invention would lead to lower the use of the muscle force as well as to a cleaner and more efficient performance, reducing unwanted spills of the contents of the toilet bowl and making it easier to clean the plunger after use.

Additional features of the disclosure will become apparent to those skilled in the art upon consideration of the following detailed description of the illustrative embodiment.

BRIEF DESCRIPTION OF THE DRAWINGS

The detailed description particularly refers to the accompanying figures in which.

DETAILED DESCRIPTION OF PREFERRED EMBODIMENTS

Figure 1:
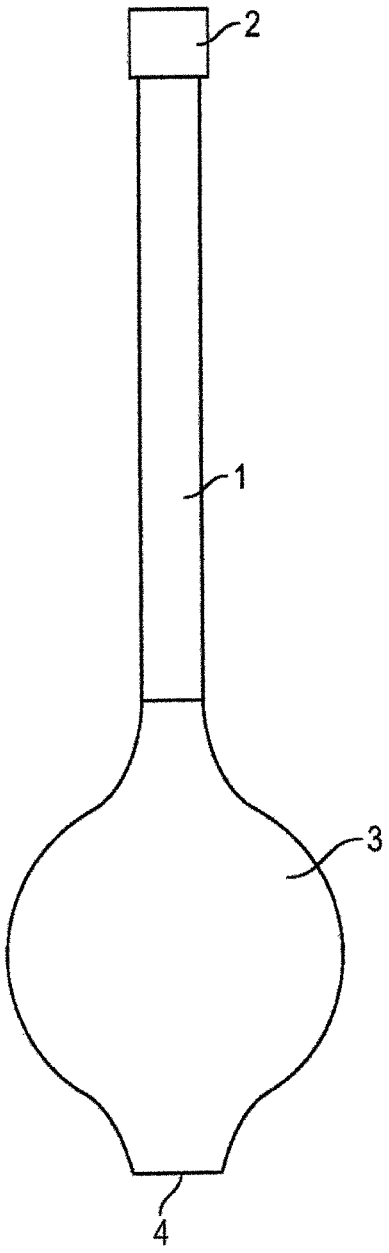
FIG. 1 is a side view of an inverted plunger according to present invention with an elastic body attached to a hollow, rigid handle with a grip.

For the purposes of promoting and understanding the principles of the invention, reference will now be made to one or more illustrative embodiments illustrated in the drawings and specific language will be used to describe the same.

Referring to FIG. 1, a side view of an inverted plunger according to present invention is depicted. A hollow, rigid handle 1 is attached to a spherical elastic body 3 having a narrow protrusion 4 on the end opposing to the hollow, rigid handle 1. Elastic body 3 is usually made of a stretchable elastic material like rubber. The hollow, rigid handle 1 is attached to the grip 2 on the end opposite to the elastic body 3. The narrow protrusion 4 is meant to be inserted into either the clogged pipe opening, or into the opening of a clogged toilet. The hollow, rigid handle 1 and grip 2 are fitted with means to apply pressure selectively to the bottom of the narrow protrusion 4, leading to the elastic material of the elastic body 3 stretching inside either the opening of the clogged pipe or the opening of the clogged toilet, creating the pressure on the liquid inside, breaking the debris.

Figure 2:
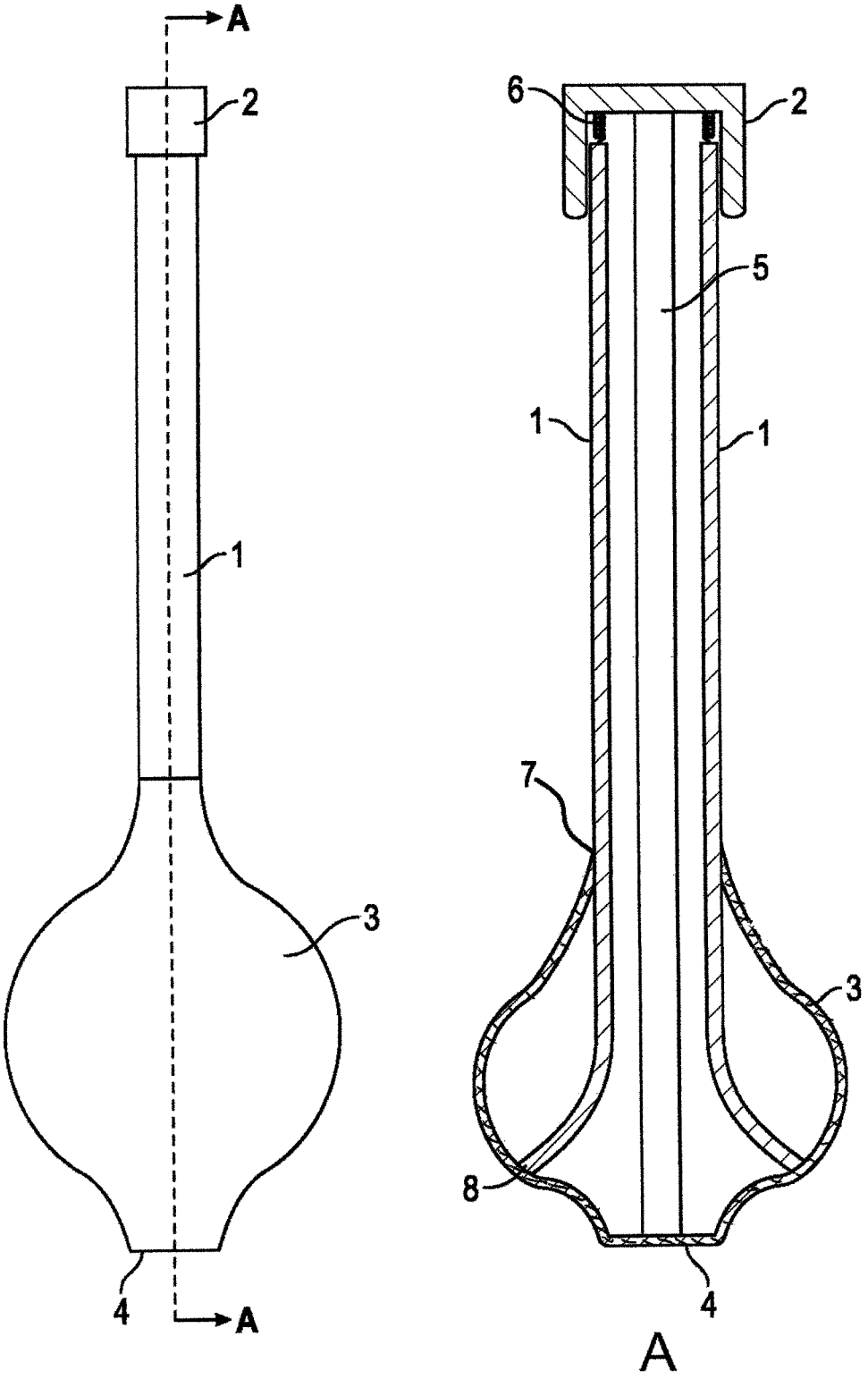
FIG. 2 is a sectional view of an inverted plunger with the grip attached to the hollow, rigid handle by means of springs and with a solid rod attached to the grip on one end and to the protrusion in the elastic body on the other end.

The sectional side view presented on FIG. 2 allows a look inside (A) the structure of one of the modifications of the inverted plunger, fully understanding the mechanism of its working. In the depicted modification, the hollow, rigid handle 1 is attached to the spherical elastic body 3 at the top (7), and also on the inside of the spherical elastic body 3 at the bottom (8), not allowing any air or liquid to penetrate inside of the spherical elastic body 3. In the depicted modification, the hollow, rigid handle 1 widens up at the bottom to have a second point of attachment 8, inside the spherical elastic body 3. The grip 2 is attached to a rod 5 inserted inside the hollow, rigid handle 1. On the side opposite to the grip, the rod 5 is attached to the narrowing protrusion 4 at the opposite end of spherical elastic body 3. The grip 2 is attached to the hollow rigid handle 1 by means of springs 6, or any other moveable attachment. The application of the pressure on grip 2 moves the rod 5 inside the hollow, rigid handle 1, leading to the expansion of the narrowing protrusion 4 inside either the opening of the clogged pipe or the opening of the clogged toilet. The repetitive application of pressure to the grip 2 leads to the repetitive vibration of the narrowing protrusion 4 inside the opening of either the clogged pipe or the opening of the clogged toiled, leading to the increased liquid pressure removing or disintegrating the clog.

Figure 3:
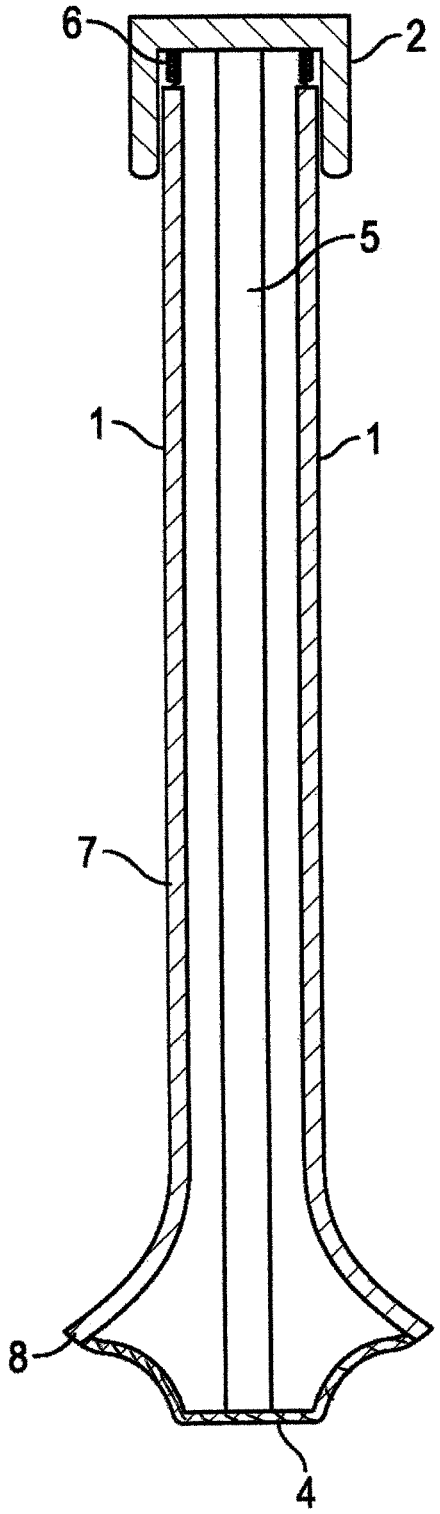
FIG. 3 is sectional view of an inverted plunger with elastic body of the inverted plunger alternatively shaped in a bowl-like silhouette.

FIG. 3 provides a sectional view of the alternative modification of the inverted plunger with the elastic body shaped as a bowl instead of a sphere. This modification could be used for cleaning pipes with the narrow opening, where the larger spherical elastic body would not fit.

Figure 4:
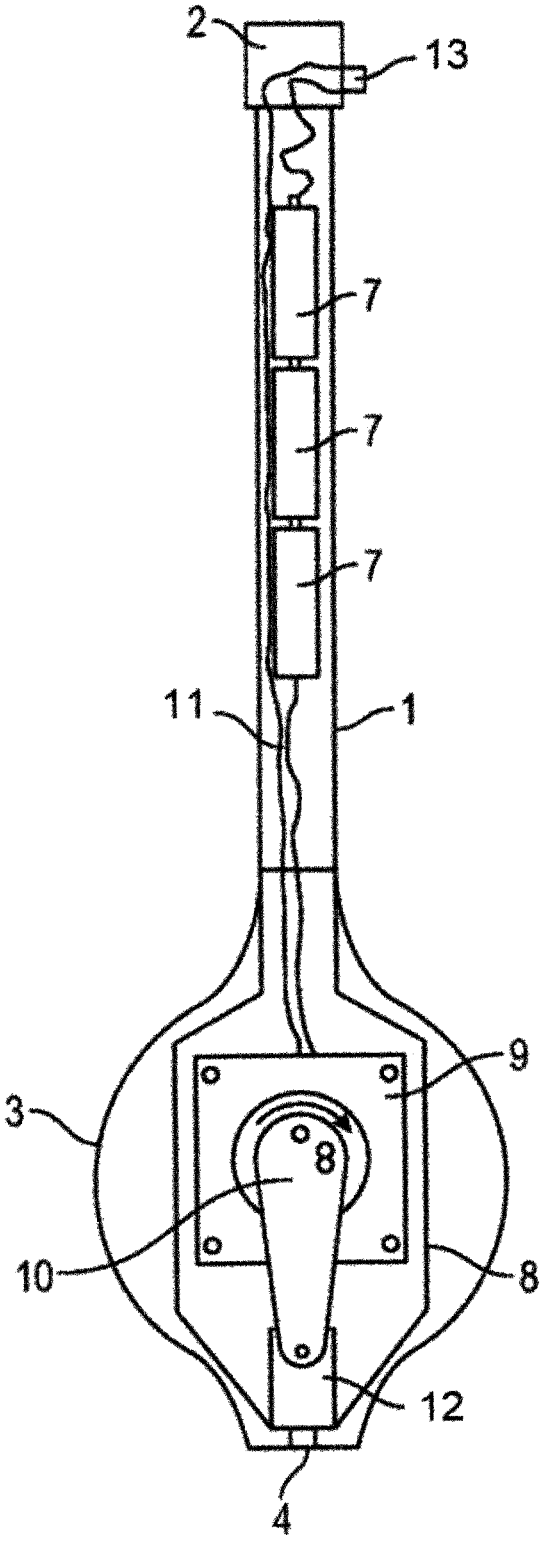
FIG. 4 is a side inside schematic view of the inverted plunger supplemented with batteries and electrical motor.

FIG. 4 depicts the schematic view inside the inverted plunger equipped with an electric motor, allowing for a high frequency of pressure application to the narrowing protrusion 4 of the elastic body 3, vastly increasing the efficiency of the inverted plunger compared to any plungers that are described in the prior art. In the depicted modification, the grip 2 is molded to the hollow, rigid handle 1, and fitted with a switch button 13. The hollow, rigid handle 1 fits energy store in form of electrical batteries 7, that are wired (11) to the switch button 13, inserted in the grip 2. The power from batteries is transferred via wires 11 to the electric rotary motor 9, that is placed inside the motor mount 8, attached directly to the hollow, rigid handle 1, and encased inside the elastic body 3. The electric motor 9 is attached to eccentric crank 10 at the top of the eccentric crank. The bottom of the eccentric crank is attached to the piston rod 12. The bottom part of the piston rod 12 is further attached to the narrowing protrusion of elastic body 4. The switch of the button 13 starts the rotation of the motor, leading to eccentric crank transferring the up-and-down movement to the piston rod and further to the narrowing protrusion of elastic body 4, sending the vibration into the clogged pipe or a clogged toilet, resulting in the breaking of the clog.

Figure 5:
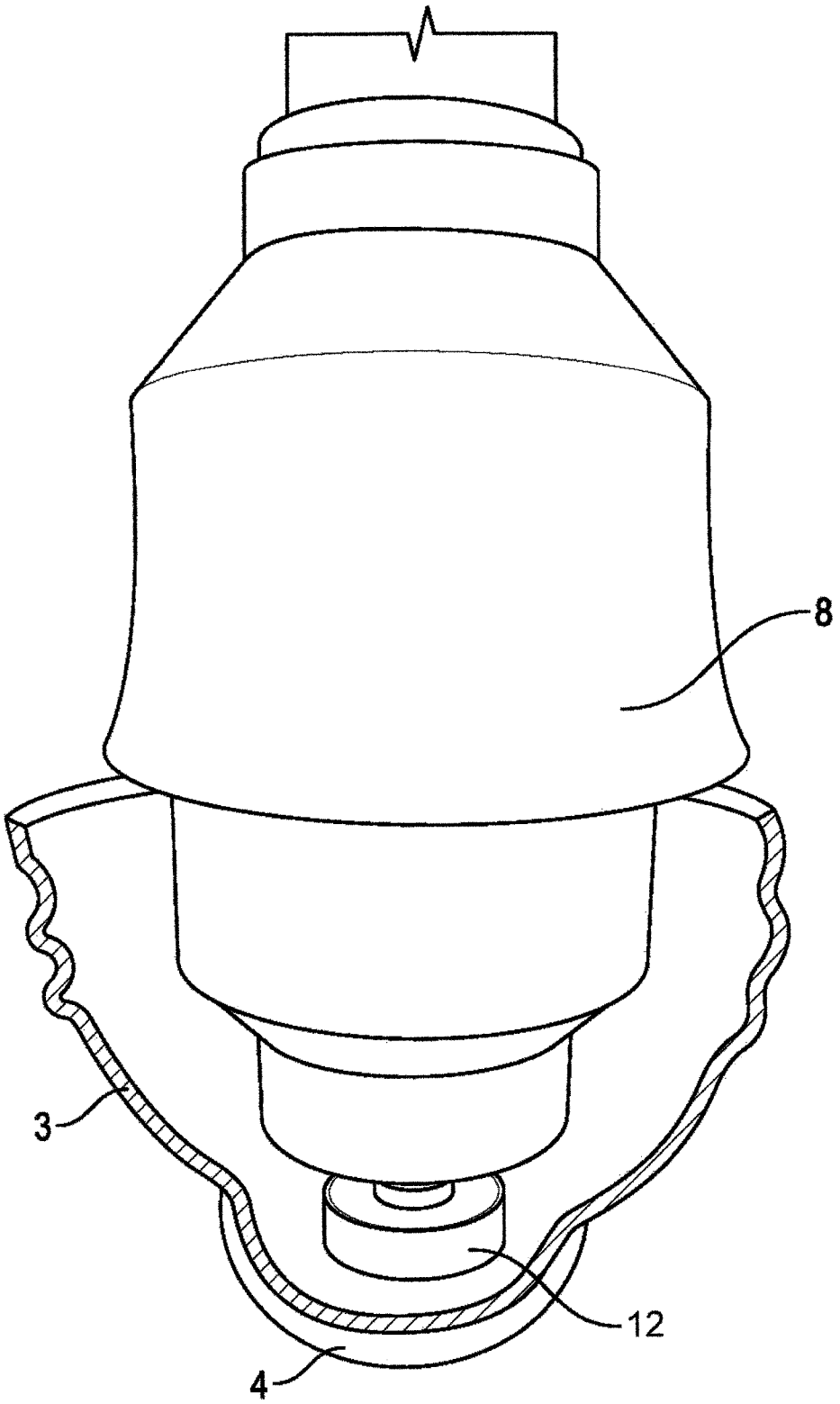
FIG. 5 is a perspective view of the bottom part of the inverted plunger with the elastic body split open demonstrating the motor mount with the attached piston rod.

FIG. 5 provides alternative perspective view of the inverted plunger equipped with a motor inside a motor mount 8, attached to the piston rod 12 by means of eccentric crank, to apply pressure on the narrowing protrusion of elastic body 4, of the bowl-shaped elastic body 3. The elastic body 3 is split open in order to have a better understanding of the internal assembly.

Figure 6:
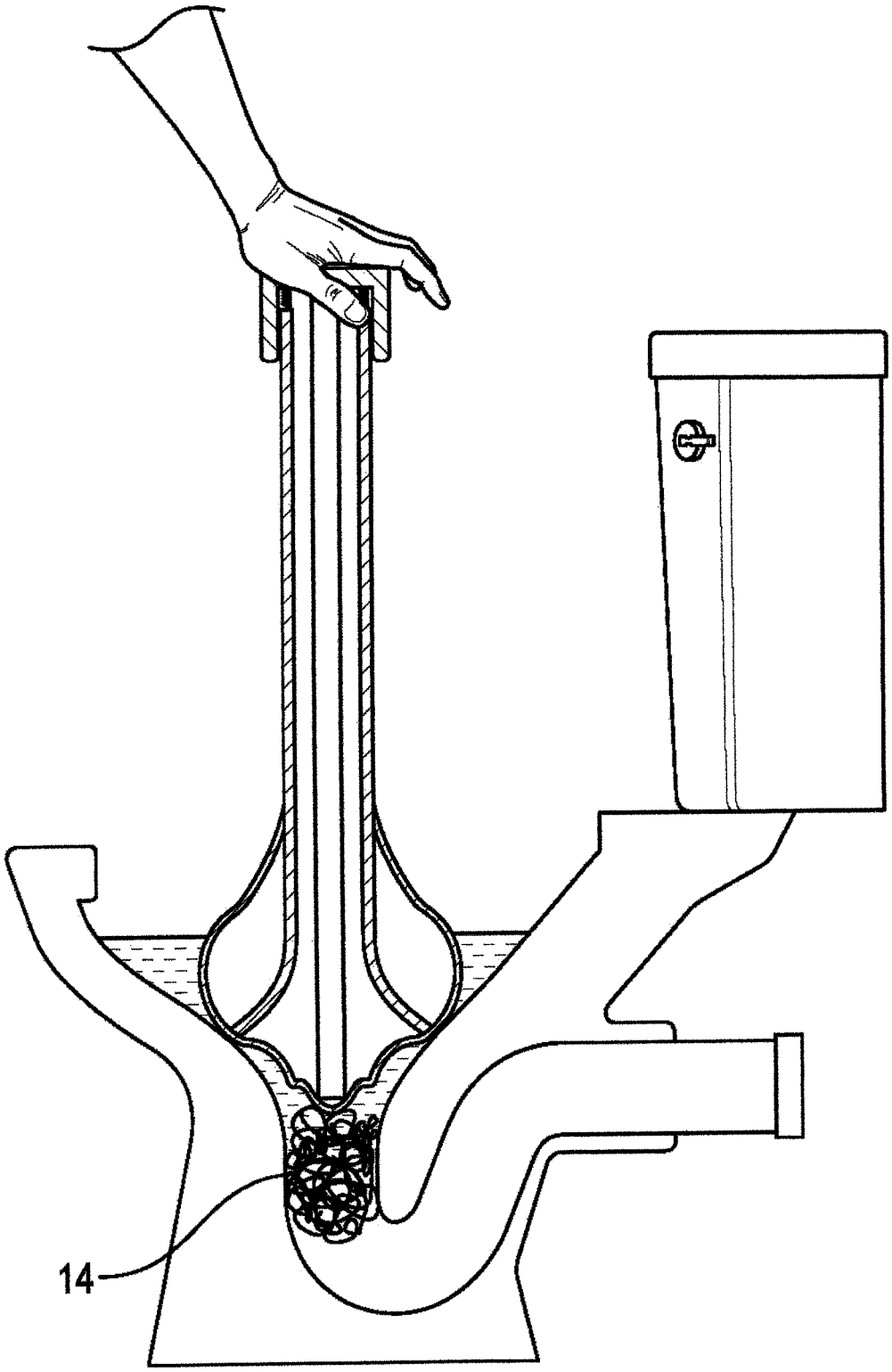
FIG. 6 is a sectional view depiction of the inverted plunger being used to remove the debris from a toilet bowl.

FIG. 6 demonstrates the method of use of the inverted plunger to remove the debris 14 from the clogged toilet. The user inserts the narrowing protrusion of the elastic body into the opening of the toilet, either applying pressure on the grip (on the depicted modification) or by switching on the button (in the modification with electric motor), leading to the movement of the narrowing protrusion of the stretchable bottom part of the inverted plunger in and out of the clogged pipe. Such movement leads to the vibration of the liquid inside the pipe, with a resulting pressure breaking and removing the debris and unclogging the pipe.

The figures provide preferred embodiment of the invention. However, the invention is not limited to the disclosed configuration. Number of different materials could be used in place of solid handle and stretchable bottom part. The stretchable bottom part could be molded in many different configurations to fit various pipes openings, or different toilet openings.

While the invention has been illustrated and described in detail in the foregoing drawings and description, the same is to be considered as illustrative and not restrictive in character, it being understood that only illustrative embodiments thereof have been shown and described and that all changes and modifications that come within the sprit and scope of the invention as defined in the following claims are desired to be protected.

The invention claimed is:

1. An inverted plunger, comprising:

a hollow, rigid handle having a first end and a second end;

an elastic body having a top end and a bottom end, wherein the top end of the elastic body is attached to the first end of said hollow, rigid handle, and the bottom end of the elastic body protrudes outwards in a direction opposite to the second end of said hollow, rigid handle;

a grip attached to the second end of said hollow, rigid handle, wherein said grip is equipped with a means to manipulate the bottom end of the elastic body to move axially relative to the hollow, rigid handle, protruding the bottom end of the elastic body in the direction opposite to the grip and wherein said elastic body encloses said means to manipulate the bottom end of the elastic both.

2. The inverted plunger of claim 1, wherein said elastic body is made from material selected from the group consisting of: silicone; mold making rubber; natural rubber; elastomers; nitrile neoprene; and vinyl.

3. The inverted plunger of claim 1, wherein said elastic body has a spherical shape.

4. The inverted plunger of claim 1, wherein said elastic body has a semi-spherical shape.

5. The inverted plunger of claim 1, wherein said grip is attached to the second end of said hollow, rigid handle by means of springs and the grip is configured to move axially relative to the hollow, rigid handle, and wherein said means to manipulate the bottom end of the elastic body further comprise a rod inserted inside the hollow, rigid handle and attached on one end to said grip and on the other end to the top end of the elastic body, and the rod can be moved axially by the axial movement of the handle.

6. The inverted plunger of claim 1, wherein said grip is molded to the second end of said hollow, rigid handle and, wherein said means to manipulate the bottom end of said elastic body further comprise:

an energy store inserted in the hollow, rigid handle;

an electrical motor fitted in the second end to the hollow, rigid handle and wired to the energy store, and having a moving piston on the end opposite to the grip, said piston being attached to the top end of said elastic body;

a button located on said grip that connects to said energy store and initiates the flow of electric current from said energy store to said motor, resulting in said piston moving said bottom end of the elastic body protruding the bottom end of the elastic body in the direction opposite to the grip.

7. A method of cleaning clogged pipes, said method comprising the steps of:

(a) providing an inverted plunger, including:

a hollow, rigid handle having a first end and a second end;

an elastic body having a top end and a bottom end, wherein the top end of the elastic body is attached to the first end of said hollow, rigid handle, and the bottom end of the elastic body protrudes outwards in a direction opposite to the second end of said hollow, rigid handle;

a grip attached to the second end of said hollow, rigid handle, wherein said grip is equipped with a means to manipulate the bottom end of the elastic body to move axially relative to the hollow, rigid handle, protruding the bottom end of the elastic body in the direction opposite to the grip, and wherein said elastic body encloses said means to manipulate the bottom end of the elastic body;

(b) placing the bottom end of the elastic body into an opening of a pipe filled with liquid and having a clog of debris obstructing a flow of liquid;

(c) manipulating the grip causing the repetitive movement of said bottom end of the elastic body further causing the vibration of liquid in the opening of a pipe;

(d) The movement of said bottom end of the elastic body resulting in breaking down the clog of debris inside the pipe, restoring the free flow of liquid.

8. A method of claim 7, wherein said method is used for unclogging toilets.

* * * * *